United States Patent [19]

Yamamoto

[11] Patent Number: 4,905,865

[45] Date of Patent: Mar. 6, 1990

[54] APERTURE STRUCTURE IN A HEAT INSULATION CONTAINER

[75] Inventor: Masayuki Yamamoto, Toyoake, Japan

[73] Assignee: Hoshizaki Electric Co., Ltd., Aichi, Japan

[21] Appl. No.: 150,371

[22] Filed: Jan. 29, 1988

[51] Int. Cl.[4] ..... B65D 9/04

[52] U.S. Cl. ..... 220/467; 220/DIG. 18; 220/465

[58] Field of Search ..... 220/467, 465, 469, 430, 220/80, DIG. 18, DIG. 9, 903; 312/214

[56] References Cited

U.S. PATENT DOCUMENTS

| | | | |
|---|---|---|---|
| 1,495,109 | 5/1924 | Reynolds | 220/DIG. 9 X |
| 3,174,642 | 3/1965 | Loewenthal | 220/467 X |
| 3,632,012 | 1/1972 | Kitson | 220/467 X |
| 3,794,396 | 2/1974 | Vick | 220/467 X |
| 3,883,198 | 5/1975 | Tillman | 220/467 X |
| 3,915,527 | 10/1975 | Besing | 220/467 X |
| 3,948,410 | 4/1976 | Anderson | 220/467 |

FOREIGN PATENT DOCUMENTS

| | | |
|---|---|---|
| 46-13329 | 5/1971 | Japan . |
| 53-37310 | 9/1978 | Japan . |

*Primary Examiner*—Harvey C. Hornsby
*Assistant Examiner*—K. O'Leary
*Attorney, Agent, or Firm*—Wenderoth, Lind & Ponack

[57] ABSTRACT

A heat insulation container includes an inner casing, an outer casing on the exterior thereof and enclosing the inner casing and defining a space therebetween in cooperation with the inner casing, and a heat insulating foamed material filling the space defined by the casings. An aperture portion is provided in the container through a wall thereof for allowing a piping of a cooling system to go in and out of the container therethrough. The aperture portion is provided with a frame therearound which comprises an annular resilient contacting member brought into hermetical sealing contact with the inner surface of either the inner casing or the outer casing in the vicinity of a periphral edge of the mouth, and an annular tong-like member engaging sealingly with the other of the inner casing and the outer casing.

9 Claims, 2 Drawing Sheets

APERTURE STRUCTURE IN A HEAT INSULATION CONTAINER

BACKGROUND OF THE INVENTION

1. Field of the Invention

This invention relates generally to an aperture structure in a heat insulation box or container and, more particularly, to such an improved and simple aperture structure which can not only facilitate fabrication and assembly of the heat insulation container, but also prevent leakage of a heat insulating material through the aperture structure when the material is charged into and foamed in the casing of the heat insulation container.

2. Prior Art

A heat insulation container is widely used in various refrigerating or cooling apparatuses such as a refrigerator, an ice-making machine, a freezing apparatus, a cold preserving box, a show-case equipped with a cooling system and others. In the refrigerating apparatuses of these types, a compressor, condenser and the like constituting a cooling system are usually disposed exteriorly of the heat insulation container while a cooler or evaporator constituting another part of the abovementioned cooling system is disposed within the heat insulation container. Accordingly, the container has to be provided with an aperture for allowing fluid communication of the compressor, condenser or the like with the cooler or evaporator accommodated therein so that a coolant can be circulated through the evaporator from the compressor.

FIG. 6 of the accompanying drawings shows a typical aperture structure of a heat insulation container known heretofore. Referring to FIG. 6 which shows, in fragmental vertical section, a wall structure defining an aperture or opening, an annular frame 3 formed of stainless steel or the like and having a channel-like cross section is fixedly mounted by means of rivets 4 on a peripheral edge portion of the aperture provided in an inner casing 1 constituting a part of the wall structure of the heat insulation container. An annular gap 5 is provided between the peripheral edge of the opening formed in an outer casing 2 and the frame 3 to block heat transmission therebetween. This gap is closed by an annular sealing film member 6 adhesively bonded to the inner surfaces of the outer casing 2 and the frame 3 for preventing a heat insulating foamed material from leaking through the gap. Additionally, a tape member 7 is adhesively bonded to an inner surface 1*a* of the inner casing 1 and an inner surface 3A of the frame 3 for hermetically sealing a junction 8 between the frame 3 and the inner casing 1 connected together by the rivets 4 as well as the riveted portions 8*a* themselves. The interior space defined by the inner casing 1, the outer casing 2 and the frame 3 is filled with the heat insulating foamed material.

In the case of the prior aperture structure described above, the film member 6 and the tape member 7 must be adhered to and annularly along the inner surfaces of the outer casing 2 and the frame 3 on one hand and to the inner surfaces of the inner casing 1 and the frame 3 on the other hand in order to prevent leakage of the heat insulating material which leakage would otherwise occur upon foaming thereof. In conjunction with the bonding or adhesion of the film member 6 and the tape member 7, experience shows that great difficulty is encountered in attaching the film member 6 to the inner surfaces of the outer casing 2 and the frame 2 in the annular form for hermetically closing or sealing the annular gap 5 between the outer casing 2 and the frame 3, involving degraded efficiency in the assembling process, even when the outer casing 2 is mounted after adhesion of the tape member 7 has been carried out following the mounting of the frame 3 to the inner casing 1 by means of the rivets 4 or the like.

SUMMARY OF THE INVENTION

Accordingly, an object of the present invention is to provide a simple aperture structure for a heat insulation container, which structure can be easily achieved through facilitated fabrication and assembling process while preventing leakage of a heat insulating material upon foaming thereof.

With this object in view, there is provided according to the present invention in its brodest aspect a heat insulation container which comprises an inner casing, an outer casing enclosing exteriorly the inner casing in spaced relation therewith for defining an interior space in cooperation with the inner casing, and a heat insulating foamed material filled in the space defined by the inner and outer casings, wherein apertures (hereinafter, referred to as an "aperture portion") are formed through the inner casing, the heat insulating foamed material and the outer casing for allowing a coolant flowing in a cooling system to be circulated through an apparatus disposed within the heat insulation container. The aperture portion is provided with a frame which has an annular resilient contacting member adapted to be brought into hermetical sealing contact with the inner surface of either one of the inner casing or the outer casing in the vicinity of a peripheral edge of the corresponding aperture, and substantially annular means for hermetically engaging the inner surface of the other of the inner and outer casings.

When the frame is to be assembled to the inner casing and the outer casing at the aperture portion, either the inner casing or the outer casing may be first connected to the frame, being followed by securing of the other casing to the connected frame. In that case, the resilient contacting member of the frame is brought into resilient contact with the inner surface of the inner or outer casing assembled later, whereby the necessity of attaching a film along and around the whole frame in an annular pattern is eliminated, while occurrence of leakage of the heat insulating material is positively prevented upon foaming thereof.

Where the engaging means for engaging the frame to either the inner casing or the outer casing is constituted by a tongue-like member which cooperates with a flange formed in the frame to hold the inner or outer casing in a sandwiched state, the frame can be brought into contact with both the inner and outer casings simultaneously. Further, since the space defined by the inner casing, the outer casing and the frame is filled with a heat insulating material which is foamed so as to surround the engaging means, undesired removal of the frame from the aperture portion can be positively prevented.

BRIEF DESCRIPTION OF THE DRAWINGS

In the course of the preceding discussion and following detailed description, reference has been and will be made to the attached drawings, wherein like reference characters denote like or corresponding parts and in which.

DESCRIPTION OF THE PREFERRED EMBODIMENT

In the following, the present invention will be described in detail in conjunction with a preferred and exemplary embodiment which is assumed, by way of example, to be applied to a refrigerator.

Figure 1:
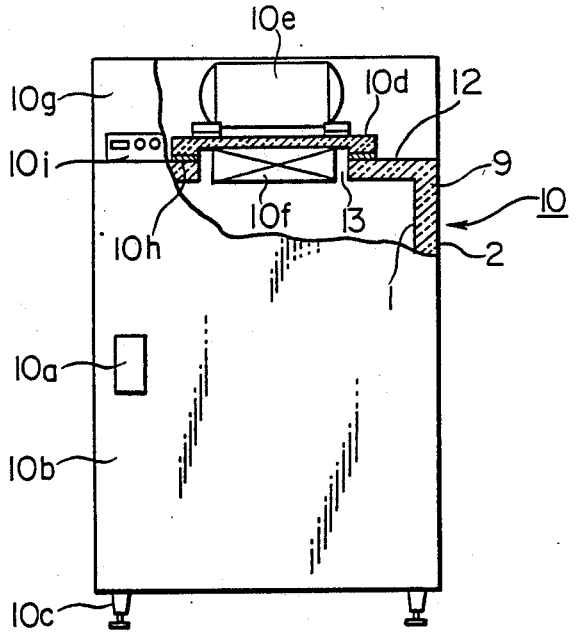
FIG. 1 is a front elevational view schematically showing, partly in section, a refrigerator in which a cooler is mounted in a heat insulation container having an aperture structure according to the present invention.

Referring to FIG. 1, a reference numeral 10 generally denotes a heat insulation container which is in the form of a box of heat insulating structure constituted by an encased heat insulating foamed material, and includes a door **10*b* provided with a gripper 10*a* and mounted for opening and closing by suitable means. The heat insulation container 10 is supported by level adjusting legs 10*c* mounted on the bottom wall of the container and has a top mount plate 10*d* on which a compresor 10*e* and a cooler 10*f* constituting a cooling system are fixedly supported. Additionally, a box-like enclosure member 10*g* is mounted by suitable means over the top wall 12 of the heat insulation container 10 for enclosing therein the compressor 10*e* and other members (not shown). The top mount plate 10*d* is constituted by an inner panel, an outer panel and a heat insulating material interposed between these panels, although it is are not visible in the drawing, and is mounted on the top wall of the heat insulation container 10 so as to cover or block a rectangular opening or aperture portion 13 formed in the top wall with a packing 10*h* of rubber or the like material being interposed between plate 10*d* and container 10 so that heat transfer from the heat insulation container 10 to the mount plate 10*d*** can be reduced to a minimum.

The compressor **10*e* and the cooler 10*f* constitute a cooling system in cooperation with coolant expansion means, condenser, pipes or ducts for interconnecting these component units in a closed loop, and other structure, although not shown, wherein the compressor 10*e*, the coolant expansion means and the condenser are installed exteriorly of the heat insulation container 10. The coolant discharged from the compressor 10*e* is fed to the cooler 10*f* through the condenser and the expansion means and subsequently fed back to the compressor 10*e*. Accordingly, it will be appreciated that a through hole (not shown) is formed in the mount plate 10*d* for allowing the aforementioned pipes to extend therethrough. A reference numeral 10*i* denotes a control panel mounted on the enclosure 10*g*** for controlling operation of the refrigerator.

Figure 2:
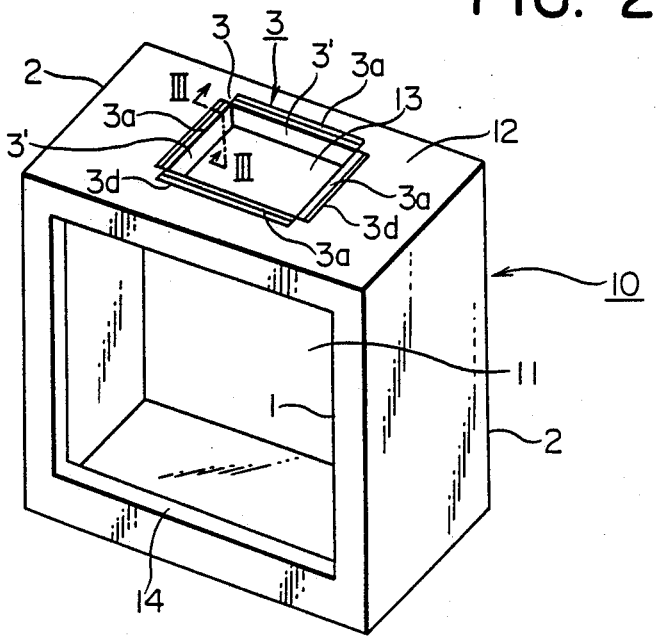
FIG. 2 is a perspective view schematically showing the heat insulation container of the refrigerator shown in FIG. 1 with a door and the cooler being omitted.

Referring to FIG. 2 together with FIG. 1, the heat insulation container 10 is constituted by an inner casing 1 and an outer casing 2 having all sides inclusive of a rear side 11 closed except for a wholly opened front side 14 and the top wall 12 provided with the aforementioned rectangular aperture portion 13. The inner casing 1 and the outer casing 2 are connected together by means of a frame structure described hereinafter, whereby a space is defined between the inner casing 1 and the outer casing 2 to be filled with a heat insulating foamed material 9.

The structure described so far has heretofore been well known and can be fully understood by those skilled in the art from the foregoing elucidation.

Figure 3:
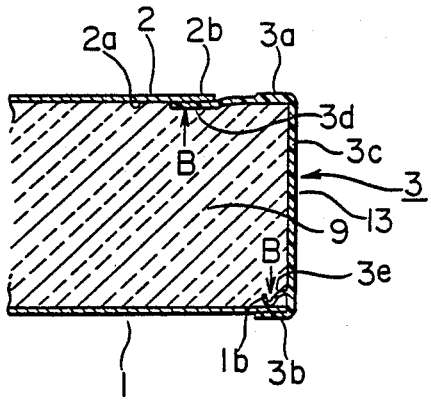
FIG. 3 is an enlarged sectional view taken along the line III—III in FIG. 2.
Figure 5:
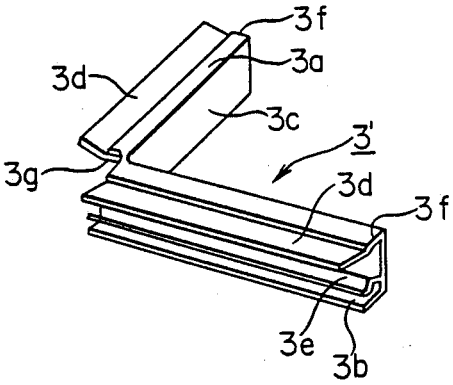
FIG. 5 is a perspective view of the same.
Figure 6:
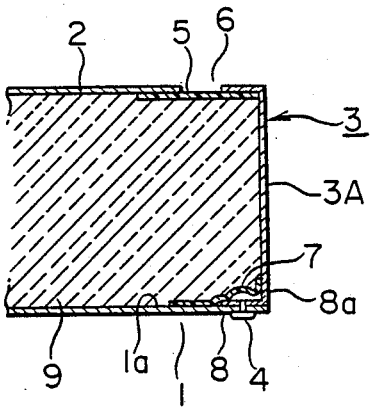
FIG. 6 (PRIOR ART)
FIG. 6 is a view similar to FIG. 3 and shows schematically an aperture structure known heretofore in a heat insulation container.

According to a preferred embodiment of the present invention, the rectangular opening or aperture portion 13 formed in the top wall 12 of the heat insulation container 10 is fitted with a frame 3 of a rectangular structure with each side being constituted by a channel member having substantially a ⊃-like cross section. As can be best seen in FIG. 3, the rectangular frame 3 is adapted to be mounted in contact on two peripheral edge portions **1*b* and 2*b* of the inner casing 1 and the outer casing 2, respectively, which define the aperture 13, as will be described in more detail hereinafter. Referring to FIG. 5, the frame 3 is constituted by a pair of substantially L-like frame portions 3' formed of a resin material such as vinyl chloride, wherein the L-like frame portions having the substantially ⊃ -like cross section are joined at both ends 3*f* thereof to the counterpart frame portion 3', to thereby constitute the frame 3 having a rectangular or square configuration as a whole. It should be mentioned that a notch 3*g* is formed at the corner of the L-like frame portions 3'**, as is also shown in FIG. 5.

Figure 4:
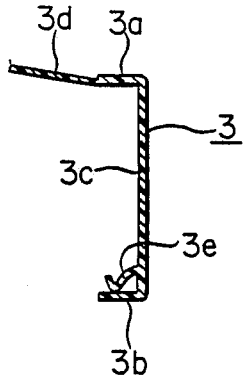
FIG. 4 is a vertical sectional view showing a portion of a frame structure.

Referring to FIGS. 2 to 5, each of the frame portions 3' includes a top flange **3*a* projecting laterally outwardly, a bottom flange 3*b* and a vertical intermediate wall 3*c* interconnecting these flanges 3*a* and 3*b*. A resilient contacting member 3*d* of relatively small thickness is formed integrally with the top flange 3*a* to project laterally outwardly from the free end or edge of the flange 3*a*. On the other hand, the vertical intermediate wall portion 3*c*** *is provided with a tongue-like member* **3*e* bent in a hook-like form at a position above the bottom flange 3*b* at such a short distance therefrom that the rounded hook portion of the tongue-like member 3*e* is brought into elastic contact with the upper surface of the bottom flange 3*b*, as is best seen in FIG. 4. Further, the tongue-like member 3*e* has a length shorter than that of the bottom flange 3*b* and is oriented at an angle of about 45° relative to the bottom flange 3*b*** as a whole.

Next, a description is given of an exemplary method of fitting the frame structure 3 to the aperture portion 13. At first, the individual frame portions 3' are placed in the opening formed in the inner casing 1 in a manner in which the peripheral edge portion **1*b* of the inner casing 1 is hermetically sandwiched between the bottom flange 3*b* and the tongue-like member 3*e*. After the pair of the frame portions 3' have been placed in the opening of the inner casing 1, rectangular and triangular sealing films or tapes (not shown) are adhered to the end portions 3*f* and the notches 3*g* for the purpose of preventing the leakage of heat insulating material upon filling and foaming thereof, which will be described hereinafter. This film attaching process is very simple as compared with the adhesion of the tape or film in the annular pattern performed in the mounting of the frame in the hitherto known heat insulation container. Subsequently, the outer casing 2 is disposed around the inner casing 1 in a manner in which the resilient contacting member 3*d* extending laterally outwardly from the top flange 3*a*** is contacted to the inner surface of the outer casing 2 in the vicinity of the peripheral edge portion 2*b*. Since the thickness of the resilient contacting member 3*d* is sufficiently smaller than that of the upper flange 3*a* to the extent that it is yieldable without losing its resiliency, the resilient contacting member 3*d* can be held in the hermetically sealing contacting state with the inner surface 2*a* of the peripheral edge portion of the outer casing 2, whereby the leakage of the heat insulating foamed material upon foaming thereof can be positively prevented by the resilient contacting member 3*d*. Since the resilient contacting member 3*d* is relatively thin (having a smaller sectional area), it has the capability to essentially interrupt the heat transfer path which otherwise could be established from the outer casing 2 to the inner casing 1 by way of the frame structure 3.

Next, an expandable heat insulating material 9 such as urethane is charged or injected into the interior space defined by the inner casing 1, the outer casing 2 and the frame 3 to be subsequently foamed. Upon filling and foaming of the heat insulating material 9, the resilient contacting member 3*d* and the tongue-like member 3*e* are subjected to pressures in the directions indicated by arrows B in FIG. 3, respectively, whereby the intimate or hermetical sealing contact between the resilient contacting member 3*d* and the outer casing 2 on one hand and between the tongue-like member 3*e* and the inner casing 1 on the other hand can be further enhanced. Since the tongue-like member 3*e* is enclosed within the heat insulation material 9, the former is integrally combined with the latter when the charged heat insulating material 9 is solidified after having been foamed, so that the frame structure 3 will be positively held by the inner casing 1 and the outer casing 2.

Although the foregoing description has been given on the assumption that the present invention is applied to the heat insulation container for a refrigerator, it should be appreciated that the teachings of the present invention can be equally applied to other heat insulation containers or boxes for various apparatuses equipped with cooling systems such as ice making machines, freezers, cold reserving boxes, show-case and the like. Although the aperture portion for pipe connection is assumed to be provided in the top wall of the heat insulation container in the foregoing description, it shold be understood that the aperture portion may also be formed in other wall than the top wall. The illustrated geometrical configurations of the resilient contact member and the tongue are only by way of example for illustration. Other forms of these members may be equally adopted so far as the similar effects can be attained. In a further modification of the illustrated embodiment, the tongue-like member may be provided in the vicinity of the top flange for holding the outer casing in the sandwiched state between the tongue-like member and the top flange of the frame while providing the resilient contacting member along the free edge of the bottom flange so that the inner casing is placed under pressure exerted by the resilient contacting member.

What I claim is:

1. A heat insulation container having an inner casing, an outer casing around the exterior of said inner casing in spaced relation thereto to define a space therebetween, a heat insulating foamed material filling said space between said inner and outer casings, said casings and foamed material constituting a wall enclosing a hollow interior and having a thickness, and having an opening therethrough adapted to be closed by a door, and further having an aperture extending through the thickness of said wall at a point spaced from said opening for allowing a coolant flowing in a cooling system having a part therof outside said container to be circulated through a part of the cooling system disposed within said container, and an aperture defining frame structure in said aperture having a frame with a vertical frame wall extending in the direction of the thickness of said wall, a sealing flange extending laterally from one end of said frame wall and an annular resilient contacting member on the outer end of said sealing flange in sealing contact with the inner surface of one of said inner casing and said outer casing in the vicinity of the peripheral edge of said aperture, and a casing engaging flange integral with and extending laterally from the other end of said frame wall, and a substantially annular resilient means integral with said frame wall and having a free end resiliently urged toward said casing engaging flange, the other of said inner casing and said outer casing being engaged and held between said engaging flange and said annular resilient means.

2. A heat insulation container as claimed in claim 1 in which said frame structure is made of a resin material.

3. A heat insulation container as claimed in claim 2 in which said frame is constituted by a pair of separate frame parts which together have the shape of said aperture, and each of which has a substantially L-shaped configuration.

4. A heat insulation container as claimed in claim 2 in which said resilient contacting member is integral with the free end of said sealing flange and said annular resilient means is constituted by an annular tongue-like member extending laterally outwardly from said vertical frame wall at a position above said casing engaging flange at a short distance therefrom.

5. A heat insulation container as claimed in claim 4 in which said tongue-like member has a hook-like cross section and is inclined from said frame wall toward said casing engaging flange and has a shorter length than said casing engaging flange.

6. A heat insulation container as claimed in claim 4 in which said resilient contacting member has a thickness less than the thickness of said sealing flange.

7. A heat insulation container as claimed in claim 4 in which said resilient contacting member is biased resiliently outwardly of said wall from the free end of said sealing flange.

8. A refrigerating apparatus comprising:

a heat insulation container having a front opening at a front side and a top wall having a top aperture extending through the thickness of said top wall;

a door mounted on said heat insulation container for closing said front opening;

a cooling system for cooling the interior of said heat insulation container and including a compressor external of said container, an evaporator disposed within said container, piping connected btween said compressor and said evaporator for circulating a coolant through said compressor and said evaporator, and a mounting plate having an upper surface and a lower surface and supporting said compressor on said upper surface and supporting said evaporator on said lower surface, said mounting plate being supported disposed on the top wall of said container at a position covering said top aperture with said piping extending through said mounting plate and said top aperture;

said heat insulation container having an inner casing, an outer casing around the exterior of said inner casing in spaced relation thereto to define a space therebetween, a heat insulating foamed material filling said space between said inner and outer casings, said casings and foamed material constituting a wall enclosing the interior, and an aperture defining frame structure in said top aperture having an inner casing, an outer casing around the exterior of said inner casing in spaced relation thereto to define a space therebetween, a heat insulating foamed material filling said space between said inner and outer casings, said casings and foamed material constituting a wall enclosing a hollow interior and having a thickness, and having an opening therethrough adapted to be closed by a door, and further having an aperture extending through the thickness of said wall at a point spaced from said opening for allowing a coolant flowing in a cooling system having a part therof outside said container to be circulated through a part of the cooling system disposed within said container, and an aperture defining frame structure in said aperture having a frame with a vertical frame wall extending in the direction of the thickness of said wall, a sealing flange extending laterally from one end of said frame wall and an annular resilient contacting member on the outer end of said sealing flange in sealing contact with the inner surface of one of said inner casing and said outer casing in the vicinity of the peripheral edge of said aperture, and a casing engaging flange integral with and extending laterally from the other end of said frame wall, and a substantially annular resilient means integral with said frame wall and having a free end resiliently urged toward said casing engaging flange, the other of said inner casing and said outer casing being engaged and held between said engaging flange and said annular resilient means.

9. An aperture defining frame structure for insertion into an aperture extending through the thickness of a wall of a heat insulation container enclosing a hollow interior, the wall being defined by an inner casing, an outer casing around the exterior of said inner casing in spaced relation thereto to define a space therebetween, and a heat insulating foamed material filling said space between said inner and outer casings, said frame structure comprising:

a frame having a vertical frame wall extending in the direction of the thickness of said wall, a sealing flange extending laterally from one end of said frame wall and an annular resilient contacting member on the outer end of said sealing flange adapted to engage in sealing contact with the inner surface of one of said inner casing and said outer casing in the vicinity of the peripheral edge of said aperture, and a casing engaging flange integral with and extending laterally from the other end of said frame wall, and a substantially annular resilient means integral with said frame wall and having a free end resiliently urged toward said casing engaging flange, said casing engaging flange and said annular resilient means being adapted to engage the other of said inner casing and said outer casing therebetween.

* * * * *